US005445531A

United States Patent [19]

Billman et al.

[11] Patent Number: 5,445,531

[45] Date of Patent: Aug. 29, 1995

[54] CARD EDGE CONNECTOR WITH SHIM LOCK AND EXTRACTOR MECHANISM

[75] Inventors: Timothy B. Billman, King; Roger L. Thrush, Clemmons, both of N.C.

[73] Assignee: The Whitaker Corporation, Wilmington, Del.

[21] Appl. No.: 294,695

[22] Filed: Aug. 23, 1994

[51] Int. Cl.[6] ..... H01R 13/629

[52] U.S. Cl. ..... 439/160; 439/157

[58] Field of Search ..... 439/152–160, 439/328, 357–358, 152–160, 328, 357–358

[56] References Cited

U.S. PATENT DOCUMENTS

| | | | |
|---|---|---|---|
| 3,573,706 | 4/1971 | Haberlen . | |
| 4,898,540 | 2/1990 | Saito | 439/153 |
| 4,973,270 | 11/1990 | Ballman et al. | 439/630 |
| 4,990,097 | 2/1991 | Billman et al. | 439/160 |
| 5,074,800 | 12/1991 | Sasao et al. | 439/157 |
| 5,106,315 | 4/1992 | Billman et al. | 439/160 |
| 5,207,598 | 5/1993 | Yamada et al. | 439/636 |
| 5,211,568 | 5/1993 | Yamada et al. | 439/157 |
| 5,302,133 | 4/1994 | Tondreault | 439/157 |
| 5,364,282 | 11/1994 | Tondreault | 439/157 |
| 5,380,213 | 1/1995 | Piorunneck et al. | 439/160 |

*Primary Examiner*—Larry I. Schwartz
*Assistant Examiner*—Jill DeMello
*Attorney, Agent, or Firm*—Robert J. Kepalka

[57] ABSTRACT

A card edge connector includes a housing (10) having a slot (12) for receiving an edge portion of a circuit card (6). A card guide (30) includes first and second walls (31, 32) arrayed on respective opposite sides of an elongation axis of the slot (12). A space (34) between the walls is greater than a thickness of the circuit card. The first wall (31) has a projection (36) extending into the space and arranged to reside above a ledge (2) of the circuit card when the card is disposed in the slot. A gap (38) between a tip of the projection (36) and the second wall (32) has a dimension at least as great as the thickness of the circuit card. The circuit card is insertable into the connector with a portion of the circuit card passing through the gap (38) until the ledge (2) is relatively below the projection (36). The ledge (2) is displaceable to a position beneath the projection (36) upon lateral movement of the circuit card, and a clearance exists between the circuit card and the second wall (32) when the circuit card is disposed in the slot and the projection resides above the ledge. A shim member (40) is insertable in the clearance and dimensioned to restrict lateral movement of the circuit card sufficiently to prevent displacement of the ledge beyond the tip of the projection, whereby the circuit card is locked in the connector.

20 Claims, 4 Drawing Sheets

CARD EDGE CONNECTOR WITH SHIM LOCK AND EXTRACTOR MECHANISM

FIELD OF THE INVENTION

The invention relates to a card edge electrical connector having a mechanism for releasably locking a circuit card in the connector and for extracting the circuit card therefrom.

BACKGROUND OF THE INVENTION

Sockets for electrically interconnecting a circuit board daughtercard to a circuit board mothercard are well-known. Such sockets include an insulative housing having an elongated slot for receiving an edge portion of the daughtercard. Contacts in the housing extend into the slot for engagement with contact pads on the daughtercard, and the contacts have leads which extend to an exterior of the housing for engagement with mating circuit traces on the mothercard.

The sockets may be either of the cam-in or direct insertion type. The cam-in type allows the daughtercard to be inserted into the slot at a first orientation with a zero insertion force. The card is then pivoted to a second orientation against spring forces exhibited by the contacts, and the card is retained in the second orientation by a latching device.

In the direct insertion type of socket, the daughtercard is inserted into the slot with a single straight line motion. There may be considerable resistance to insertion of the card due to friction forces of the contacts wiping against the card as the card is inserted into the slot. The contacts exert a normal force on the card in the slot, and these normal forces generate a frictional resistance to removal of the card from the socket. The frictional resistance contributes greatly to retaining the card in the socket and may be sufficient to retain the card in some cases. However, the cards are manufactured with a tolerance on their thickness, and a card that is near the minimum thickness will experience less frictional resistance than a card that is near the maximum thickness. Since vibration, shock and thermal stresses can cause a card to back out of its socket, additional retention mechanisms have been employed to ensure retention of the card therein.

U.S. Pat. No. 4,973,270 discloses a direct insertion type socket having card guides at each end which define grooves aligned with the card receiving slots. Opposed walls of each groove include a pair of opposed ridges which are spaced apart by a distance which is less than a minimum thickness of the card to be received therein. One of the walls is relatively thin so as to be somewhat flexible. Insertion of a daughtercard between the walls deflects the flexible wall and expands the groove, thereby frictionally retaining the card. The flexible wall also accommodates cards having different thicknesses.

A problem with this socket arises in that a card which is near the maximum allowable thickness is retained with a relatively high frictional force which may make extraction difficult. Further, components of modern electronic packages are mounted in close proximity, thereby limiting access to the components and hindering extraction of cards from their sockets. In order to aid card removal, sockets having a positive extraction mechanism have been developed. U.S. Pat. No. 4,990,097 discloses a card extraction member having a projection at one end which underlies the circuit card, and a handle at an opposite end. The extraction member upwardly slidable to uplift the circuit card from the socket. Pivotable extraction members are also known.

U.S. Pat. No. 5,074,800 discloses a pivotable lever having a locking mechanism and an extraction mechanism for a card edge connector. The extraction mechanism comprises an extractor foot that underlies the circuit card to enable ejection thereof. The locking mechanism includes lock arms having projections which engage in an associated locking hole in the circuit card from opposite sides thereof to lock the card in the socket. A problem exists in that circuit cards, or module cards, are produced in at least two standard types each having a locking hole at a respective specified dimension from an edge of the card. The locking projections must be disposed to engage in the locking hole of one of the standard card types, and the locking projections for different card types are not interchangeable. Also, due to dimensional tolerances on the lever and the card, there is a possibility that a load may be placed on the extractor during locking of the card in the socket. There is a need for a locking and extraction mechanism which will accommodate different standard card types. There is also a need for a locking and extraction mechanism which will eliminate the possibility of placing a load on the extractor during locking of the card in the socket.

SUMMARY OF THE INVENTION

It is an object of the invention to improve the retention and extraction of a circuit card in a socket.

It is another object of the invention to provide a socket with a card locking mechanism which will accommodate different standard card types.

It is a further object of the invention to provide a socket with a combination circuit card lock and extractor.

It is yet another object of the invention to provide a socket with a card locking and extraction mechanism that does not place a load on the extractor during card locking.

These and other objects are accomplished by a socket for electrically connecting a circuit card to a substrate, comprising a housing which defines an elongated slot dimensioned for receiving an edge portion of the circuit card. A plurality of contacts extend into the slot for electrically engaging respective contact pads on the circuit card, and leads of the contacts extend to an exterior of the housing for electrically engaging respective circuit traces on the substrate. A card guide at one end of the slot includes first and second spaced apart walls arrayed on respective opposite sides of an elongation axis of the slot. A space between the walls is greater than a thickness of the circuit card. The first wall has a projection extending into the space and arranged to reside above a ledge of the circuit card when the circuit card is disposed in the slot. A gap between a tip of the projection and the second wall has a dimension at least as great as the thickness of the circuit card, whereby the circuit card is insertable into the socket with a portion of the circuit card passing through the gap until the ledge is relatively below the projection, the ledge is displaceable to a position beneath the projection upon relative lateral movement of the circuit card, and whereby a clearance exists between the circuit card and the second wall when the circuit card is disposed in the slot and the projection resides above the ledge. A shim member insertable in the clearance is dimensioned to restrict lateral movement of the circuit card sufficiently to prevent displacement of the ledge beyond the tip of the projection, whereby the circuit card is locked in the socket.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
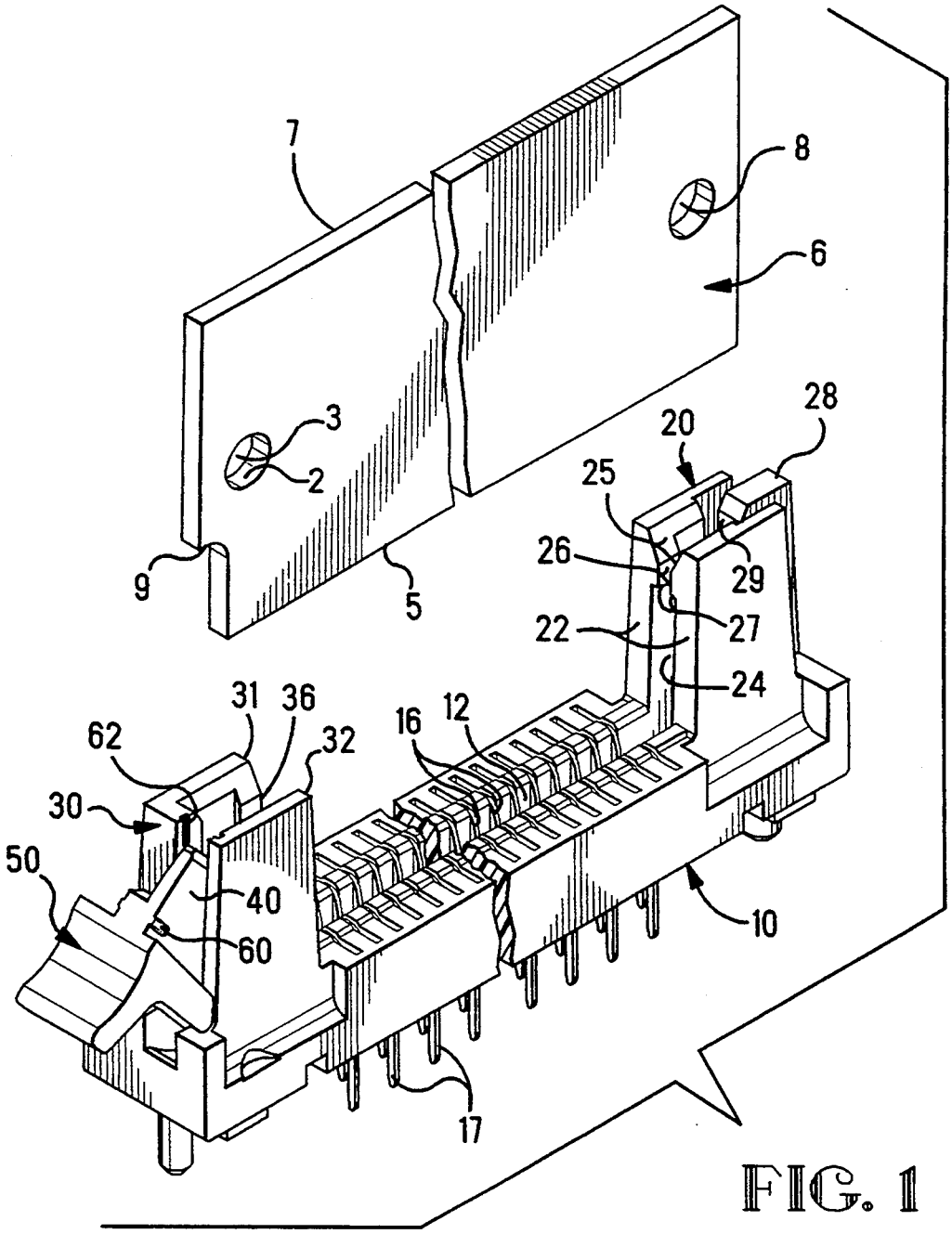
FIG. 1 is an isometric view of a socket according to the invention.

There is shown in FIG. 1 a socket according to the invention comprising a housing 10 made from an insulative material, preferably a liquid crystal polymer. The housing 10 has an elongated slot 12 which extends between opposite ends of the housing 10. The slot 12 is dimensioned to receive a circuit panel daughtercard 6 having contact pads (not shown) along a margin area adjacent edge 5 of the card. Contacts 16 which are disposed in grooves in the housing 10 extend into the slot 12 for electrically engaging the contact pads on the circuit card 6 when it is received in the slot 12. The contacts 16 have respective leads 17 which extend to an exterior of the housing 10 for electrically engaging respective circuit traces on a mothercard substrate (not shown) such as by conventional surface mount or through-hole solder techniques.

Figure 2:
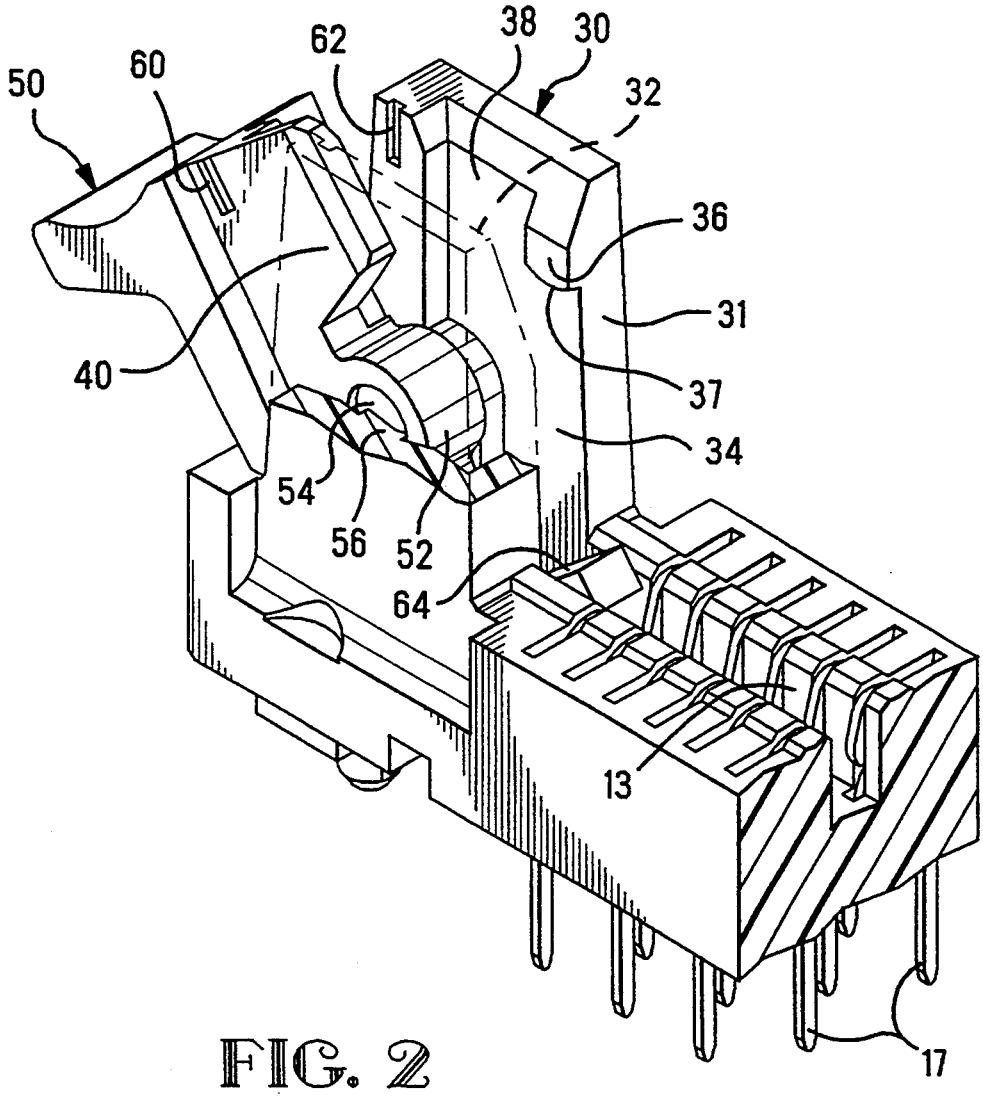
FIG. 2 is an isometric view of a card guide at one end of the socket, the view being taken at an orientation which is rotated 90° from the orientation of FIG. 1.
Figure 3:
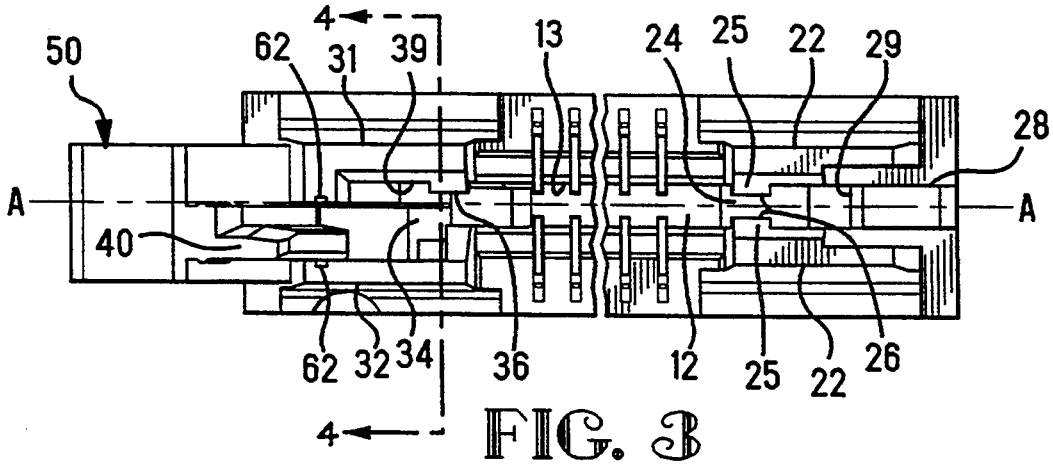
FIG. 3 is a top view of the socket having a lock lever in an unlocked position.

As shown in FIGS. 1–3, the housing 10 has card guides or supports 20, 30 at respective opposite ends thereof for stabilizing the card in the socket. The card guide 20 comprises a pair of upstanding walls 22 having a space or groove 24 therebetween. The card guide 30 comprises a first wall 31 and a spaced apart second wall 32, a space between the walls 31, 32 forming a groove 34. The walls of each card guide are arrayed on respective opposite sides of an elongation axis A—A of the slot 12, and the grooves 24 and 34 are aligned with and open to the slot 12 at respective opposite ends thereof. The slot 12 and the grooves 24, 34 are slightly wider than the thickness of the circuit card 6 to permit insertion of the circuit card therein.

As best seen in FIGS. 1 and 3, the card guide 20 has opposed projections 26 extending from upper ends of the walls 22. A dimension between the projections 26 is selected to be marginally narrower than the thickness of the circuit card 6. The walls 22 are somewhat flexible due to their cantilever attachment to the housing 10 to allow bending of the walls 22 and increased separation of the projections 26 so that the card 6 may be inserted into the socket. The projections 26 are arranged to align with hole 8 in the card 6 when the card is fully inserted in the socket.

The card guide 20 further comprises an end beam 28 having a surface 29 which serves to axially locate the card 6 in the slot 12.

Referring to FIGS. 1–4 the card guide 30 has a projection 36 extending from the first wall 31 partially across the groove 34 toward the second wall 32. The projection 36 is dimensioned such that a gap 38 between a tip of the projection 36 and the second wall 32 is at least as great as the thickness of the card 6, whereby the card 6 may still be inserted easily into the groove 34. Preferably, surface 39 of the first wall 31 is coplanar with side 13 of the slot 12 and, for a circuit card having a nominal thickness of 0.050 inch, the gap 38 is on the order of 0.040 inch.

The projection 36 is arranged to reside above a ledge 2 of the card 6 when the card is disposed in the slot 12. In the present example the ledge 2 of the card 6 is defined by a wall surface of hole 3 in the card, although the ledge could simply be defined by a top edge 7 of the card 6. The wall 31 is preferably rigid so that it will not bend and thereby withdraw the projection 36 from above the ledge 2. Rigidity is achieved by a relatively greater thickness of the first wall 31 as compared to the second wall 32.

The card 6 is insertable into the socket with a substantially straight-in motion. At the card guide 20 end of the socket, the leading edge 5 of the card engages beveled top surfaces 25 of the projections 26 and cams the projections outwardly of the plane of the card so that the card can slip between the projections 26 until the projections 26 become aligned with and enter the hole 8. The beveled top surfaces 25 also serve to pinch the card 6 from opposite sides thereof once the card is disposed in the slot to help stabilize the card in the socket. Bottom surfaces 27 of the projections 26 have a slight bevel of approximately 15° upwardly as the bottom surfaces extend toward their respective projection tips. The beveled bottom surfaces contribute to camming of the projections outwardly of the plane of the card as the card is urged upwardly during removal of the card from the socket.

Figure 5:
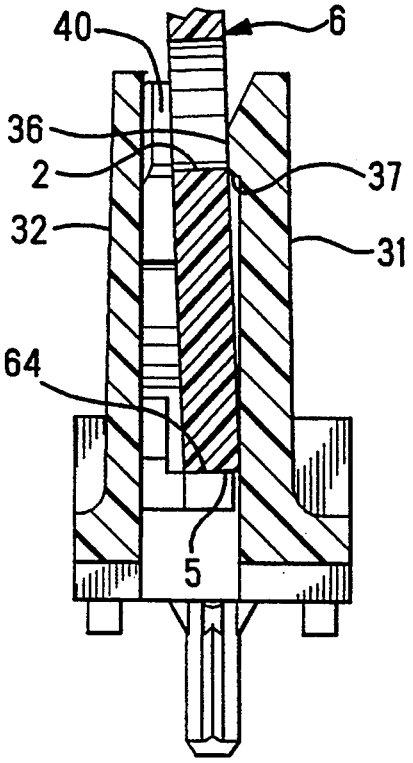
FIG. 5 is a cross-sectional view showing partial insertion of a circuit card in the socket.
Figure 6:
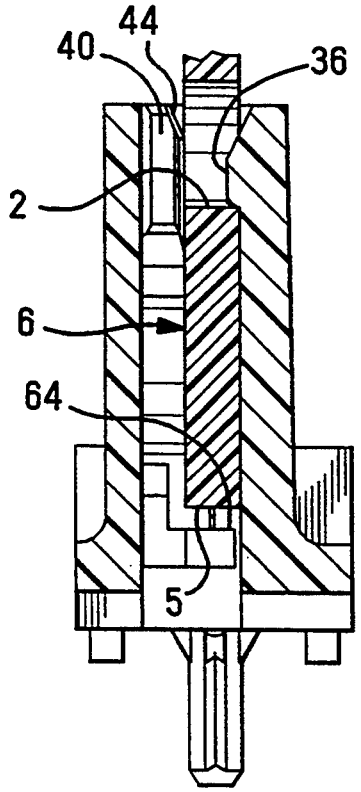
FIG. 6 is a cross-sectional view showing the circuit card locked in the socket.
Figure 9:
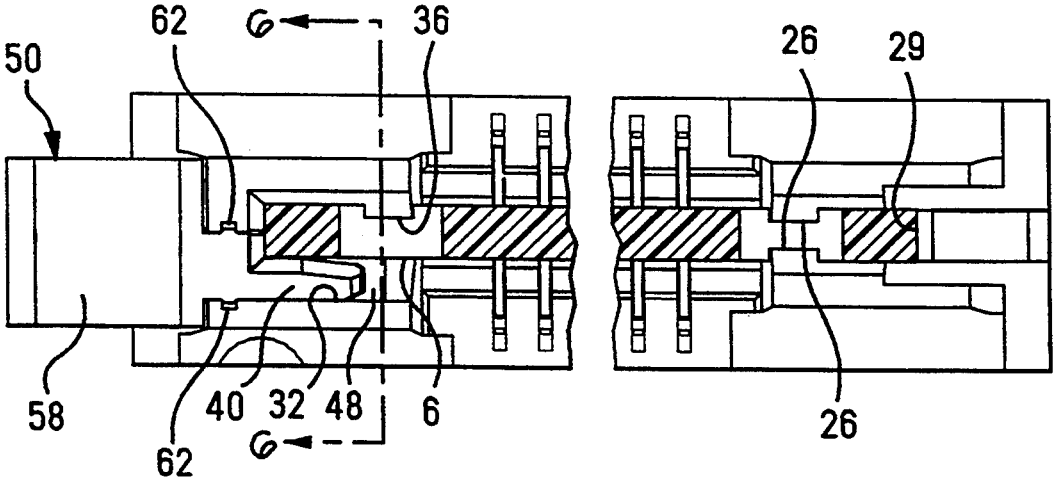
FIG. 9 is a top view of the socket having a circuit card therein and the lock lever in a locked position.

At the card guide 30 end of the socket, as a portion of the card 6 passes through the gap 38, the card is offset slightly from vertical, as shown in FIG. 5. When the ledge 2 is relatively below a bottom 37 of the projection 36, the card is inserted sufficiently in the slot 12 for proper engagement of the socket contacts 16 with their respective contact pads on the card. The card is then pivotably moveable laterally to displace the ledge 2 to a position beneath the projection 36, as shown in FIG. 6. With the card in this position a clearance 48 exists between the card 6 and the second wall 32, as shown in FIG. 9, the clearance 48 being less than a width of the gap 38 due to some thickness of the card extending beyond the tip of the projection 36.

Figure 4:
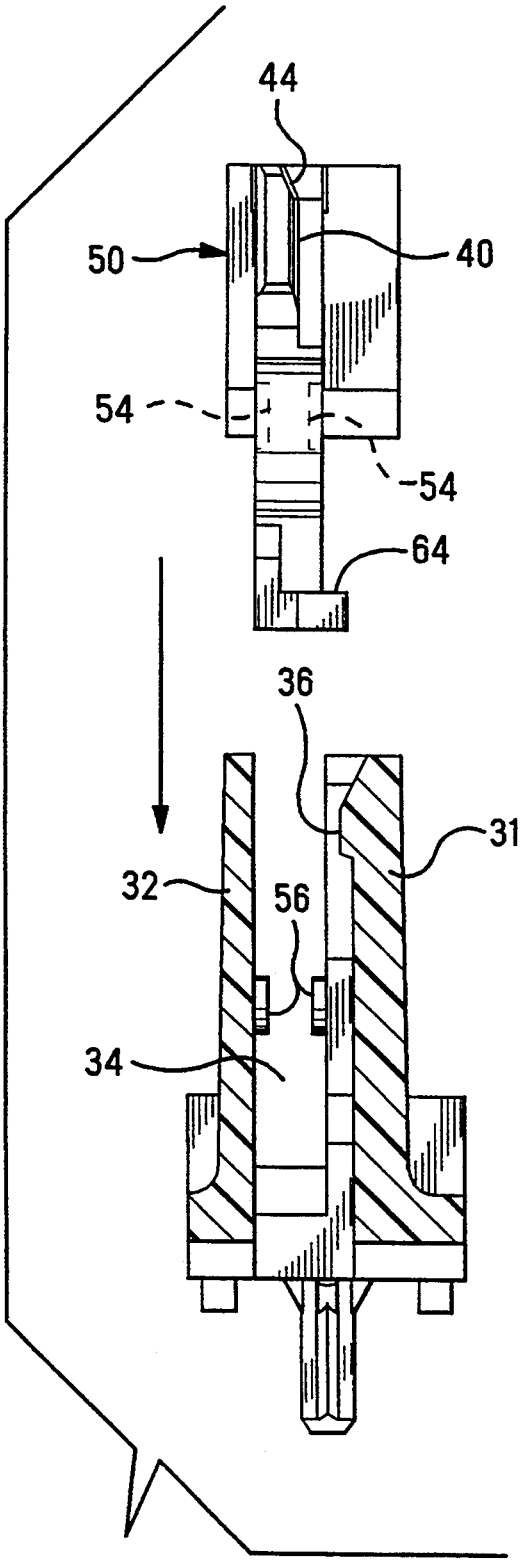
FIG. 4 is a cross-sectional view taken along line 4—4 of FIG. 3, showing the lock lever exploded away.
Figure 7:
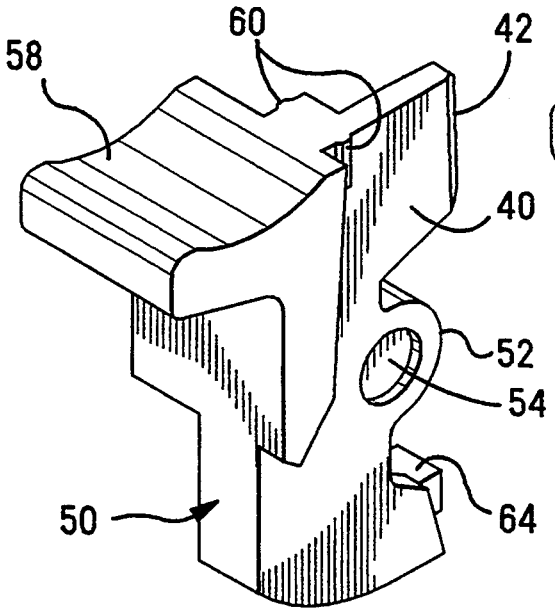
FIG. 7 is an isometric view of the lock lever.
Figure 8:
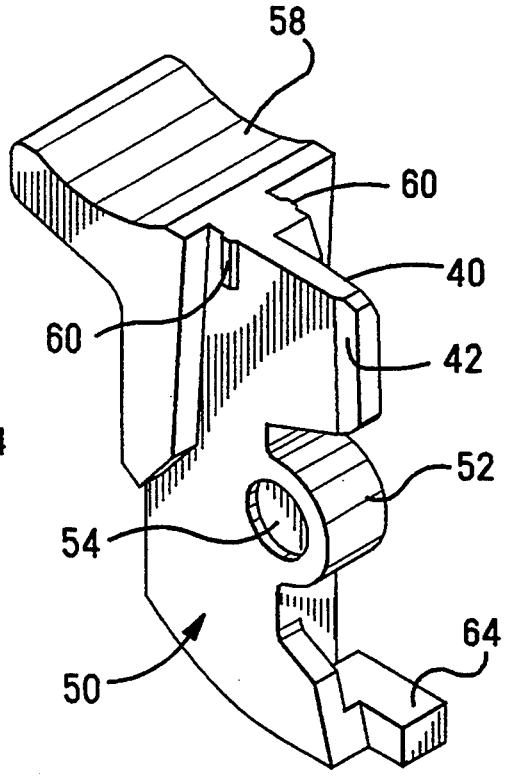
FIG. 8 is an isometric view of the lock lever rotated 90° from the view of FIG. 7.

According to the invention, a shim member 40 is movable between a lock position wherein the shim member 40 is disposed in the clearance 48, and an unlock position wherein the shim member is withdrawn from the clearance. In a preferred embodiment the shim member 40 is an integral part of a lock lever 50 which is pivotally connected to the housing 10. As shown in FIGS. 7 and 8, the lock lever 50 has a boss with an arcuate shaped front surface 52. Cylindrical recesses 54 formed in side walls of the boss receive journals 56 which extend into the groove 34 of the card guide 30 from the walls 31 and 32, as shown in FIG. 4. The lock lever 50 is pivotable on the journals 56 on an axis transverse to the elongation axis A—A of the slot. The lock lever 50 has a finger grip 58 to aid pivoting actuation thereof. A notch surface 9 of the card 6 rides on the arcuate shaped surface 52 to further locate and stabilize the card in the socket.

Lugs 60 on the lock lever 50 cooperate with detents 62 in the first and second walls 31, 32 to provide a means for releasably holding the lock lever in the lock position.

The shim member 40 is a plate-like extension having a thickness which is on the order of several thousandths of an inch greater than the width of the clearance 48. A leading edge 42 of the shim member is beveled to assist entry of the shim member into the clearance 48, and the shim member resides in the clearance with an interference fit between the second wall 32 and the card 6. The second wall 32 is not as stiff as the rigid first wall 31, and the second wall 32 may bend upon insertion of the shim member 40 in the clearance, which bending reduces resistance to insertion of the shim member and serves to accommodate cards having a thickness which is near a maximum of the card thickness tolerance.

The lock lever 50 also includes extractor foot 64 which underlies the leading edge 5 of the card when the card is disposed in the slot. The extractor foot 64 kicks an end of the card out of the slot when the lock lever is pivoted to the unlock position. The bottom surface 37 of the projection 36 has a slight bevel of approximately 15° upwardly as the bottom surface extends toward the projection tip, the bevel serving to cam the card outwardly of the ledge 36 as the extractor foot urges the card upwardly.

As shown in FIG. 5, insertion of the card into the socket causes pivoting of the lock lever and movement of shim member 40 to the locked position as the leading edge 5 urges the extractor foot 64 downwardly.

As shown in FIG. 6, a clearance exists between the leading edge 5 and the extractor foot 64 when the lock lever and shim member 40 are moved fully to the lock position.

It is preferred that the lock lever 50 be in the unlock position shown in FIG. 2 before inserting the card into the socket. However, operating personnel may not be cognizant of the preferred method of operation of the locking mechanism or may not be meticulous in performing preferred operations, and it is anticipated that personnel will attempt to insert the card into the socket with the lock lever in the lock position. It is an advantage of the invention that the card may be inserted into the socket even when the lock lever carrying the shim member 40 is in the lock position shown in FIG. 6, without detriment to the lock and extractor mechanism. Beveled upper edge 44 of the shim member 40 acts as a guide and camming surface to guide the card into the slot and cam the shim member 40 away from the projection 36, in conjunction with bending of the wall 32, until the ledge 2 passes beneath the projection 36, thereby allowing the card to slide between the projection 36 and the shim member 40 even when the lock lever is in the lock position.

A socket according to the invention may have a lock and extractor mechanism at one or both ends of the slot 12. Further, multiple lock and extractor mechanisms may be incorporated in a multi-card electrical connector such as a dual row, dual in-line memory module (DIMM) socket which has a pair of card-receiving slots in parallel, side-by-side arrangement. The dual row DIMM socket may have a single or a pair of lock and extractor mechanisms dedicated to each row of the socket.

A socket according to the invention has the advantages that a circuit card is locked in the socket by a shim member that prevents lateral movement of the circuit card so that a ledge of the circuit card is maintained beneath a projection of the socket. The shim member is disposed on a lock lever having an extractor foot. The extractor foot is not placed under any load when the card is locked in the socket. Further, the lock lever having the shim member and extractor foot is readily adapted for use with different standard types of module cards.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket for electrically connecting a circuit card to a substrate, comprising:

a housing which defines an elongated slot extending along an elongation axis and dimensioned for receiving an edge portion of the circuit card;

a plurality of contacts extending into the slot for electrically engaging respective contact pads on the circuit card, leads of the contacts extending to an exterior of the housing for electrically engaging respective circuit traces on the substrate;

a card guide at one end of the slot, the card guide including first and second spaced apart walls arrayed on respective opposite sides of the elongation axis, a space between the walls being greater than a thickness of the circuit card, the first wall being substantially rigid and having a projection extending into the space in a fixed position and arranged to reside above a ledge of the circuit card when the circuit card is disposed in the slot, a gap between a tip of the projection and the second wall having a dimension at least as great as the thickness of the circuit card, whereby the circuit card is insertable into the socket with a portion of the circuit card passing through the gap until the ledge is relatively below the projection, the ledge is displaceable to a position beneath the projection upon relative lateral movement of the circuit card, and whereby a clearance exists between the circuit card and the second wall when the circuit card is disposed in the slot and the projection resides above the ledge; and, a shim member insertable in the clearance and dimensioned to restrict lateral movement of the circuit card sufficiently to prevent displacement of the ledge beyond the tip of the projection, whereby the circuit card is locked in the socket.

2. The socket according to claim 1, wherein the shim member is coupled to the housing and is movable between a lock position wherein the shim member is disposed in the clearance, and an unlock position wherein the shim member is withdrawn from the clearance.

3. The socket according to claim 2, further comprising an extractor connected to urge the circuit card out of the slot when the shim member is moved to the unlock position.

4. The socket according to claim 3, wherein the shim member and the extractor are integrated parts of a lock lever which is pivotally connected to the housing.

5. The socket according to claim 4, wherein the extractor underlies the edge portion of the circuit card.

6. The socket according to claim 4, wherein the lock lever is pivotable on an axis extending transverse to the elongation axis.

7. The socket according to claim 3, wherein a bottom surface of the projection is beveled upwardly as the bottom surface extends toward the tip of the projection.

8. A socket for electrically connecting a circuit card to a substrate, the circuit card having an aperture therethrough, the socket comprising:

a housing which defines an elongated slot extending along an elongation axis and dimensioned for receiving an edge portion of the circuit card;

a plurality of contacts extending into the slot for electrically engaging respective contact pads on the circuit card, leads of the contacts extending to an exterior of the housing for electrically engaging respective circuit traces on the substrate;

a card guide at one end of the slot, the card guide including first and second spaced apart walls, the first wall being coplanar with a side of the slot on one side of the elongation axis, the second wall being disposed on an opposite side of the elongation axis, a space between the walls being greater than a thickness of the circuit card, the first wall being substantially rigid and having a projection extending into the space in a fixed position and arranged to reside in the aperture when the circuit card is disposed in the slot, a gap between a tip of the projection and the second wall having a dimension at least as great as the thickness of the circuit card, whereby the circuit card is insertable into the socket with a portion of the circuit card passing through the gap until the projection is aligned with the aperture, the aperture is displaceable to a position surrounding the projection upon relative lateral movement of the circuit card, and whereby a clearance exists between the circuit card and the second wall when the circuit card is disposed in the slot and the projection is disposed in the aperture; and, a shim member insertable in the clearance and dimensioned to restrict lateral movement of the circuit card sufficient to prevent displacement of the aperture beyond the tip of the projection, whereby the circuit card is locked in the socket.

9. The socket according to claim 8, wherein the shim is coupled to the housing and is movable between a lock position wherein the shim is disposed in the clearance, and an unlock position wherein the shim is withdrawn from the clearance.

10. The socket according to claim 9, further comprising an extractor connected to urge the circuit card out of the slot when the shim is moved to the unlock position.

11. The socket according to claim 10, wherein the shim and the extractor are integral parts of a lock lever which is pivotally connected to the housing.

12. The socket according to claim 11, wherein the extractor underlies the edge portion of the circuit card.

13. The socket according to claim 11, wherein the lock lever is pivotable on an axis extending transverse to the elongation axis.

14. The socket according to claim 10, wherein a bottom surface of the projection is beveled upwardly as the bottom surface extends toward the tip of the projection.

15. A socket for electrically connecting a circuit card to a substrate, the circuit card having an aperture therethrough, the socket comprising:

a housing which defines an elongated slot extending along an elongation axis and dimensioned for receiving an edge portion of the circuit card;

a plurality of contacts extending into the slot for electrically engaging respective contact pads on the circuit card, leads of the contacts extending to an exterior of the housing for electrically engaging respective circuit traces on the substrate;

a card guide at one end of the slot, the card guide including first and second spaced apart walls, the first wall being coplanar with a side of the slot on one side of the elongation axis, the second wall being disposed on an opposite side of the elongation axis, a space between the walls being greater than a thickness of the circuit card, the first wall being substantially rigid and having a projection extending into the space in a fixed position and arranged to reside in the aperture when the circuit card is disposed in the slot, a gap between a tip of the projection and the second wall having a dimension at least as great as the thickness of the circuit card, whereby the circuit card is insertable into the socket with a portion of the circuit card passing through the gap until the projection is aligned with the aperture, the aperture is displaceable to a position surrounding the projection upon relative lateral movement of the circuit card, and whereby a clearance exists between the circuit card and the second wall when the circuit card is disposed on the slot and the projection is disposed in the aperture; and, a lock lever having a shim member, the lock lever being movable between a lock position wherein the shim member is disposed in the clearance, thereby preventing removal of the circuit card from the socket, and an unlock position wherein the shim member is withdrawn from the clearance, thereby permitting lateral movement of the circuit card so as to displace the aperture beyond the tip of the projection such that the circuit card may be withdrawn from the slot.

16. The socket according to claim 15, further comprising an extractor connected to urge the circuit card out of the slot when the lock lever is moved to the unlock position.

17. The socket according to claim 16, wherein the extractor is integral with the lock lever.

18. The socket according to claim 17, wherein the lock lever is pivotally connected to the housing.

19. The socket according to claim 18, wherein the extractor underlies the edge portion of the circuit card.

20. The socket according to claim 17, wherein a bottom surface of the projection is beveled upwardly as the bottom surface extends toward the tip of the projection.

* * * * *